US005619757A

United States Patent [19]

Baratta

[11] Patent Number: 5,619,757

[45] Date of Patent: Apr. 15, 1997

[54] DISPOSABLE INFLATABLE SANITARY TOILET SEAT COVER

[76] Inventor: Richard A. Baratta, 150 N. Banana River Dr., Merritt Island, Fla. 32952

[21] Appl. No.: 517,972

[22] Filed: Aug. 22, 1995

[51] Int. Cl.[6] ..... A47K 13/00

[52] U.S. Cl. ..... 4/239; 4/456; 4/245.1

[58] Field of Search ..... 4/245.1–245.7, 4/237, 239, 456

[56] References Cited

U.S. PATENT DOCUMENTS

| | | | |
|---|---|---|---|
| D. 255,922 | 7/1980 | Price et al. . | |
| 950,758 | 3/1910 | Redmond . | |
| 1,304,511 | 5/1919 | Quackenbush . | |
| 1,575,640 | 3/1926 | Ragland | 4/237 |
| 1,676,243 | 7/1928 | Berentsen . | |
| 1,733,080 | 10/1929 | Hamilton . | |
| 3,153,248 | 10/1964 | Miller | 4/239 |
| 3,808,612 | 5/1974 | Boyle et al. | 4/239 |
| 4,181,096 | 1/1980 | Grubman . | |
| 4,806,406 | 2/1989 | Akerman et al. . | |
| 4,891,847 | 1/1990 | Baker et al. . | |
| 5,224,223 | 7/1993 | Royal . | |
| 5,394,571 | 3/1995 | Vernon . | |

FOREIGN PATENT DOCUMENTS

| | | | |
|---|---|---|---|
| 2501962 | 7/1976 | Germany . | |
| 0097133 | 12/1983 | Germany . | |
| 342784 | 2/1931 | United Kingdom . | |
| 0946152 | 1/1964 | United Kingdom | 4/237 |
| 1387994 | 3/1975 | United Kingdom . | |

*Primary Examiner*—Charles E. Phillips
*Attorney, Agent, or Firm*—Richard C. Litman

[57] ABSTRACT

A disposable, inflatable, sanitary toilet seat cover which both prevents contact of a person with the surface of the seat and creates a restricted seat opening for use by a small child. A pair of preshaped vinyl or plastic layered sheets form a top and a bottom layer, secured to one another by welds, which welds are permanent and air-tight, to form an inflatable, generally U-shaped cover adapted in size and dimension to seat on the upper surface and over edges of a standard hard toilet seat. The top layer is preformed and dimensioned to be slightly larger in surface area than the bottom layer. Upon inflation, this added surface area results in a greater curvature of the upper surface of the cover than its lower surface with resultant bulging. A series of approximately parallel, spaced welds extend generally perpendicularly from near the peripheral weld across the width of the cover, whereby the top layer and the bottom layers are bonded to one another on their interior surfaces. The space between the welds define air-filled sections with a downward extending gripping lip to prevent lateral movement of the seat cover. The cover includes an inlet valve for inflation by mouth and a outlet valve for manual deflation.

9 Claims, 3 Drawing Sheets

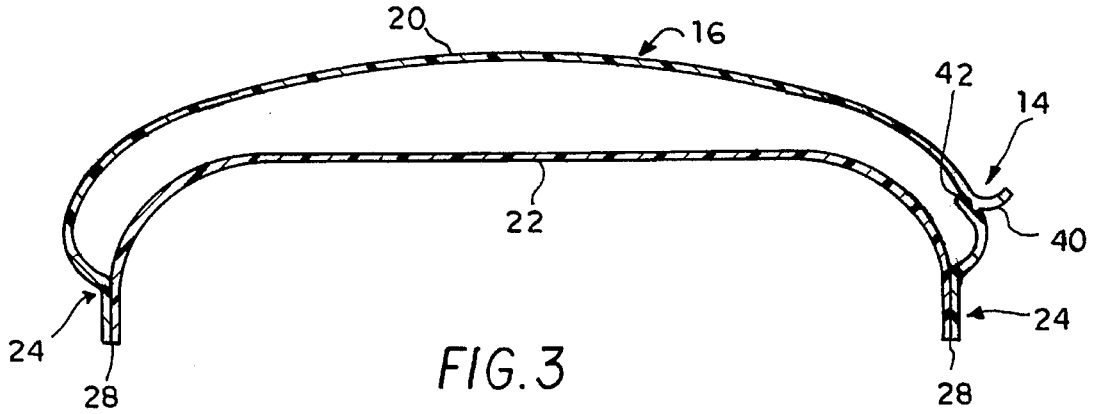
FIG. 3
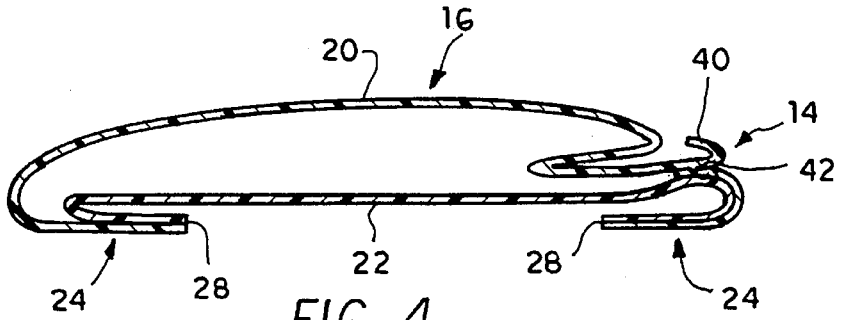
FIG. 4
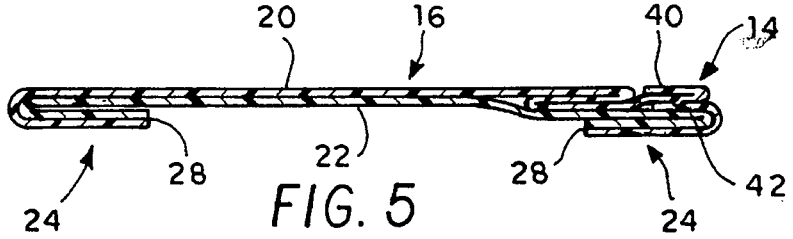
FIG. 5
FIG. 6
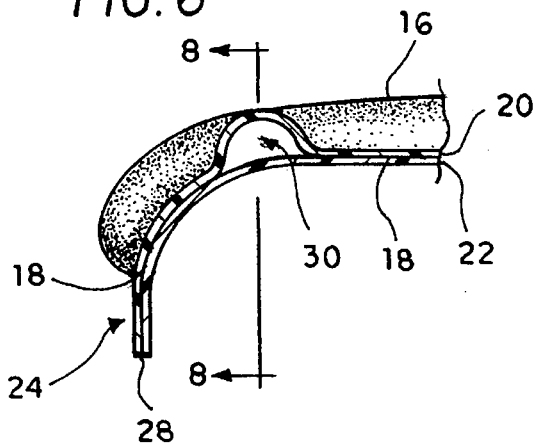
FIG. 6A
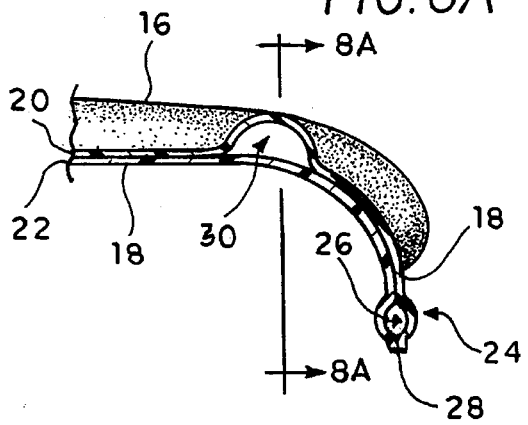

DISPOSABLE INFLATABLE SANITARY TOILET SEAT COVER

BACKGROUND OF THE INVENTION

1. Field of the Invention

The present invention relates generally to covers for toilet seats and, more particularly, to a disposable inflatable sanitary toilet seat cover which both prevents contact of a person with the surface of the seat and creates a restricted seat opening for use by a small child.

2. Description of the Prior Art

Disposable, sanitary toilet seat covers are known in the prior art and serve various and often multiple purposes. However, the means by which a seat cover is made disposable, compact, economical and hygienic in use are in large part limited by the ability of the toilet seat cover to remain secured to the toilet seat.

To achieve these purposes, numerous approaches have been taken with resulting advantages and disadvantages. One group of simple toilet seat covers is directed towards providing a disposable sheet material, such as a paper or plastic film, structured as a sleeve or layered surface which covers or envelopes the seat. For example, U.S. Pat. No. 1,304,511 issued May 20, 1919 to Quackenbush describes a sanitary toilet seat cover made of two layers of sheet material secured at the edges and folded so that a section can be removed along a scored line from one corner to form an opening in the center of the sheet when unfolded. U.S. Pat. No. 4,806,406 issued Feb. 21, 1989 to Akerman et al. describes a sanitary cover for toilet seats made up of a generally flat ended oval envelope with a central opening which is slidably received by a toilet seat. A similar paper sleeve toilet seat cover by Page is seen in British Pat. Specification No. 1 387 994 published Mar. 19, 1975. These type of toilet seat covers all have the disadvantage that they require careful initial positioning of the cover to avoid contact by the user with the toilet seat. Moreover, once positioned, by simple shifting of a seated individual the seat covers can slip laterally across the surface of the toilet seat, causing exposure to a potentially unsanitary condition.

British Pat. Specification No. 342,784 issued Feb. 9, 1931 to Hedgecock et al. describes a toilet seat cover in which metal springs are used to adapt a disinfectable rubber sheet material to the toilet seat. Present day materials make these means obsolete. European Patent Application 0 097 133 published Dec. 28, 1983 by Bassi discloses a single layer sheet material including two annular resilient edges provided with elastic bands. Both require careful initial positioning of the cover to avoid contact by the user with the toilet seat.

Another group of devices found in the prior art are primarily intended to aid in the toilet training of children, or in some cases, pets. For example, U.S. Pat. No. 950,758 issued Mar. 1, 1910 to Redmond describes a nursery seat made of disinfectable fabric with a central opening with edges turned upon themselves to form pockets through which hollow stiff tubes can be inserted. The tubes are then connected to one another to form a rectangular frame. U.S. Pat. No. 1,676,243 issued Jul. 10, 1928 to Berentsen describes a seat cover for infant's toilets made of a waterproof material with an upper and lower flap, the upper flap being connected to the infants garment and the lower flap hanging into a child seat opening to provide a guide into a bedpot. U.S. Pat. No. 1,733,080 issued Oct. 22, 1929 to Hamilton describes a child's seat attachment for toilet seats using hook supports which attach directly to the toilet seat and support a rubber sheet material with a central opening. U.S. Pat. No. 4,181,096 issued Jan. 1, 1980 to Grubman describes a hard seat with a ramp for use by pets. However, none of these type of devices are economically disposable or of simple enough construction to be conveniently carried in a rolled or folded condition and stored in small space like a pouch.

U.S. Des. Pat. No. 255,922 issued to Price et al. shows a flat disc-like design for a child's disposable toilet seat; however, no means for preventing lateral movement of the disc is readily apparent.

Another group of devices describe means of creating an inflatable cushion or "donut". Use of a plastic film or other similar sheet material allows economical, disposable and inflatable seat cushions to be made for various purposes. However, the means by which each described seat cushion remains seated over the toilet seat vary; each such invention thus trades its ability to perform a certain function for a loss in effectiveness for other purposes.

For example, U.S. Pat. No. 3,808,612 issued May 7, 1974 to Boyle et al. describes an elliptical inflatable toilet seat having a male deflector. The ellipse is sized and dimensioned so that when positioned over the central opening of a fixed hard toilet seat, lateral relative movement of the inflatable seat is precluded by the user's weight loading the elliptical portions which deform to provide an integral securing lip inside the central opening of the seat. Essentially, the inflatable seat is a elliptical "donut" sized to fit within the inner circumference of a hard toilet seat opening without falling through the opening under the weight of an individual. However, the device has disadvantages. First, a substantial volume of air is required to inflate the seat to obtain the proper support, and thus is time-consuming and inconvenient to inflate. Second, it fails to cover the entirety of the hard toilet seat; thus, for example, as a child grasps the seat rim for balance, the hands are exposed to the unsanitary conditions of the toilet seat.

U.S. Pat. No. 4,891,847 issued Jan. 9, 1990 to Baker et al. describes an inflatable annular cushion for assisting in the prevention of incontinence. Strap handles are used to support the cushion against the buttocks with no additional means for securing the donut to the toilet seat. Moreover, the cushion is not intended to be economically disposable for use in ordinarily encountered public or unsanitary restroom facilities. German Offenlegungsschrift 25 01 962 by Sakanek, published Jul. 22, 1976, describes a series of reusable air and foam filled pockets which are hinged together to form a toilet seat cover. Suction cups secure the seat cover to the toilet seat.

Numerous inflatable devices in the prior art are intended for the collection of human waste. For example, U.S. Pat. No. 5,224,223 issued Jul. 6, 1993 to Royal describes a disposable inflatable bedpan. U.S. Pat. No. 5,394,571 issued Mar. 7, 1995 to Vernon discloses an inflatable bedpan with disposable liner. None of these inventions disclose means for use on toilet seats.

Despite the various means by which a toilet seat cover have been adapted for use with a hard fixed toilet seat, a need still exists for a suitable means to achieve a disposable, sanitary, inflatable toilet seat cover, which when deflated and folded is very compact, yet capable of being quickly inflated; which, when inflated, provides a cushioning means by which the upper surface of the seat is quickly and easily, essentially in one step, covered in order to prevent contact of the seat with the user, whereby the seat supports both the cover and the user; and which is unitarily and integrally adapted to prevent lateral slippage of the cover from the toilet seat.

None of the above inventions and patents, taken either singly or in combination, is seen to describe the instant invention as claimed.

SUMMARY OF THE INVENTION

The present invention relates generally to covers for toilet seats and, more particularly, to a disposable inflatable sanitary toilet seat cover which both prevents contact of a person with the surface of the seat and creates a restricted seat opening for use by a small child.

The preferred embodiment is made of a pair of preshaped vinyl or plastic layered sheets, forming a top layer and a bottom layer, secured to one another by welds, which welds are permanent and airtight. The top layer and bottom layer are generally U-shaped and adapted in size and dimension to seat on the upper surface and over edges of a standard hard toilet seat. The top layer is preformed and dimensioned to be slightly larger in surface area than the bottom layer. Upon inflation, this added surface area results in a greater curvature of the upper surface of the cover than its lower surface. The resulting cover is preferably only a few centimeters in height when inflated, having a gripping lip extending downwards along its periphery and bulging outward from the edge of the toilet seat.

With reference to the cover in its deflated state, the edge of the top layer is circumferentially welded to the bottom layer to form a tubular assembly, having an interior surface and an exterior surface, and forming an airtight seal around its periphery. The tubular assembly is configured to have two arms and an arc (forming the "U"). A series of approximately parallel, spaced arm welds extend generally perpendicularly from near the peripheral weld across the width of the arms, whereby the top layer and the bottom layers are bonded to one another on their interior surfaces. The space between the arm welds define generally rectangular sections. The welds also extend across the arc, but are radially spaced to define truncated pie-shaped sections. However, each of both the arm welds and the arc welds are broken into two or more segments, defining a passage between the interior surfaces of the top and bottom layers for the free flow of air from section to section.

The gripping lip prevents lateral movement of the seat cover when placed onto the toilet seat while the cover is inflated. By virtue of the added surface area of the upper layer and the welds bonding the upper layer to the bottom layer, the sections formed between the welds form a cover being generally U-shaped in cross-section. The gripping lip is that portion of the cover which downwardly overhangs the edges of the toilet seat. The arm and arc welds may be spaced a slight distance from the peripheral weld to allow a circumferential passage of air which forms a small tubular protrusion along the periphery of the tubular assembly. This protrusion further grasps the underside of the toilet seat. The stiffness and thickness of the plastic or vinyl may also be varied to provide resistance to deformation of welds upon inflation, whereby the U-shape of the cross section or tubular protrusion may be enhanced.

The tubular assembly includes an inlet valve located in the arc, for inflation of the cover by mouth, and a outlet valve, located along at least one portion of the exterior surface of the cover for manual deflation of the cover.

The inlet valve is a tube, having a proximate end and a distal end, the distal end being integrally and permanently connected to the base of a vesicle, formed by an inpouching of a wall of the tubular assembly and stiffened to maintain its shape in the absence of a deforming force. Each of a pair of opposing adhesive areas are located on the interior surface of the wall of the cover, above and below the vesicle.

Before inflation, the exterior air is in communication with the interior air of the tubular assembly through the tube, the distal end of the tube being engulfed by the walls of the vesicle and the vesicle separating the opposing adhesive areas. Upon inflation, the tube may be manually pulled in the direction of its longitudinal axis, inverting the vesicle's walls, whereby the tube is entirely extruded from the vesicle. With a manual pinching action, the opposing adhesive areas on the interior of the wall may be brought together when the cover is fully inflated, forming a air-tight seal behind the tube.

The outlet valve is a longitudinal slit located on the wall of at least one arm over which a flap is sealed by an adhesive strip. The adhesive strip is located on the interior surface of the flap and makes contact with the exterior surface of the wall of the cover to form a releasable seal. Alternative valves, such as plastic zipper lock strips (of the ZIP-LOCK™ type), may be used.

Accordingly, it is a principal object of the invention to provide a toilet seat cover intended for improved hygienic use with hard toilet seats, which is flexible and foldable for compact storage, quickly inflatable by mouth, quickly deflatable to minimize user contact after use, and disposable.

It is another object of the invention to provide a means by which an inflatable toilet seat cover is capable of semi-rigidly gripping the upper surface and outer and inner edges of a hard toilet seat, whereby the seat supports both the cover and the user.

It is a further object of the invention to provide an inflation and deflation means for an inflatable toilet seat cover.

Still another object of the invention is to provide a cushioning means for hard toilet seats, wherein the upper surface and outer and inner edges of a hard toilet seat is entirely covered in order to prevent contact of the seat with the user and creates a cushioned and restricted seat opening.

These and other objects of the present invention will become readily apparent upon further review of the following specification and drawings.

BRIEF DESCRIPTION OF THE DRAWINGS

FIG. 3 is a cross section of a chamber of the toilet seat cover, fully inflated, drawn along lines 3—3 of FIG. 2

FIG. 4 is a cross section of a chamber of the toilet seat cover, as shown in FIG. 3, partially inflated.

FIG. 5 is a cross section of a chamber of the toilet seat cover as shown in FIG. 3 and FIG. 4, fully deflated.

FIG. 6 is a partial elevational cross section of the welds and chambers of the toilet seat cover, fully inflated, drawn along lines 6—6 of FIG. 2.

FIG. 6A is an elevational cross section of a second embodiment of the toilet seat cover.

Similar reference characters denote corresponding features consistently throughout the attached drawings.

DETAILED DESCRIPTION OF THE PREFERRED EMBODIMENTS

Figure 1:
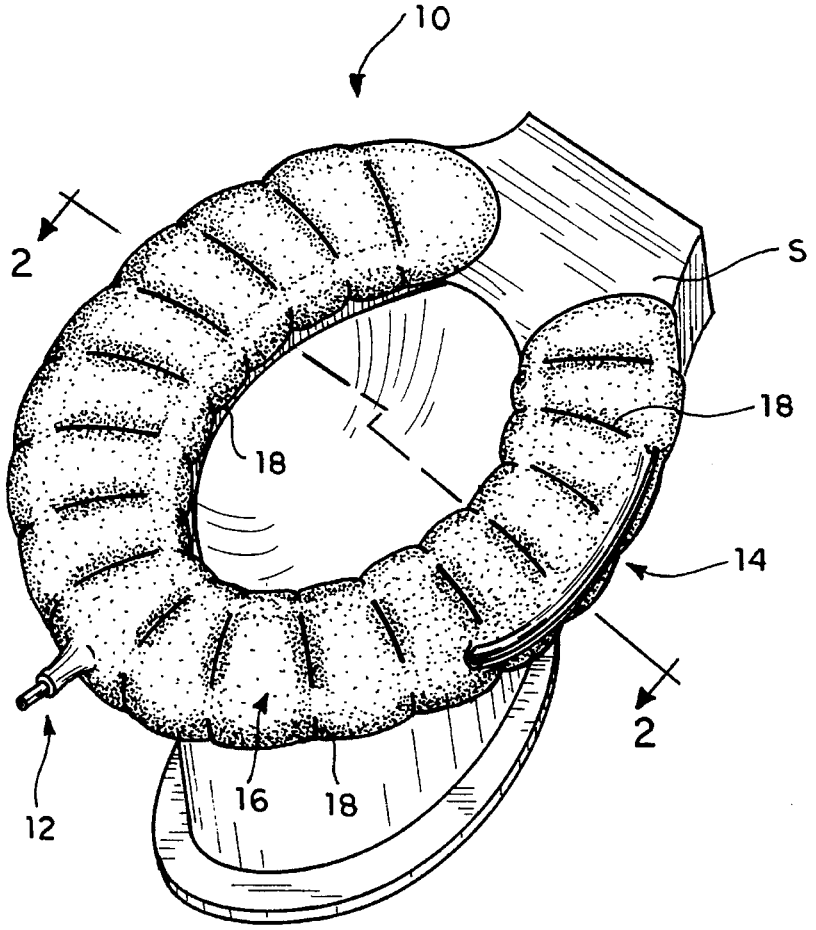
FIG. 1 is an environmental perspective view of the toilet seat cover.
Figure 2:
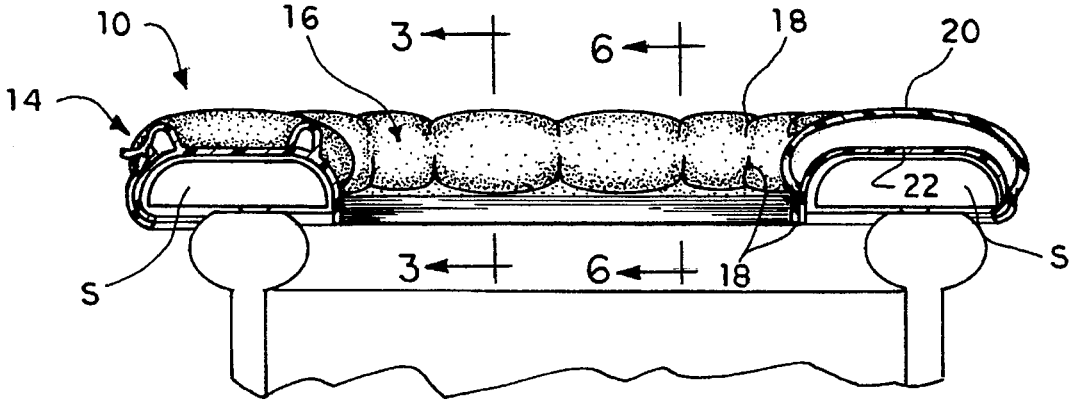
FIG. 2 is an elevational cross section of the toilet seat cover drawn along lines 2—2 of FIG. 1.

The present invention relates generally to covers for toilet seats and, more particularly, to a disposable inflatable sanitary toilet seat cover which both prevents contact of a person with the surface of the seat and creates a restricted seat opening for use by a small child. Referring to FIGS. 1 and 2, the preferred embodiment of the toilet seat cover 10 is shown inflated, a tubular assembly configured to have two arms and an arc, each arm and the arc having an inner and an outer edge generally forming a U-shape, and adapted in size and dimension to the standard hard toilet seat S. The cover 10 is inflated by means of an inlet valve 12 which is permanently sealed after fully inflating the cover 10, and, deflated by an outlet valve 14. The cover 10 is segmented by a plurality of straight welds 18 into a plurality of inflated sections 16.

FIGS. 3, 4 and 5 show various stages of inflation of a section 16. FIG. 5 shows the section 16 fully deflated, allowing the cover to be compactly folded and sealed in a pouch for convenience. FIG. 4 shows the section 16 as it would be seen in a partially inflated state, before reaching its fully inflated state as shown in FIG. 3.

Figure 7:
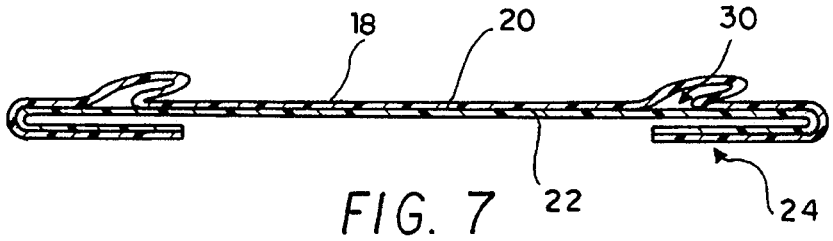
FIG. 7 is a cross section of the welds and chambers of the toilet seat cover, partially inflated.

As can be best appreciated from FIG. 3, a pair of preferably preshaped vinyl or plastic sheets form a top layer 20 and a bottom layer 22 for each section 16, secured to one another by a peripheral weld 28 extending from the inner edge to the outer edge of the arms and the arc, i.e., along the entire edge of the sheet, thus forming a tubular assembly having an interior surface and an exterior surface and forming an airtight seal around its periphery. The peripheral weld 28 and straight welds 18 are permanent and airtight and allow the cover 10 to be inflated. By comparing FIG. 3 to FIG. 6, the section 16 can be contrasted to a cross section taken through the straight welds 18 which are interrupted by a pair of air passages 30 connecting each section 16. FIG. 7 shows the same cross section in which the air passages 30 is nearly fully deflated. It can be readily observed from either FIG. 6 or FIG. 7 that the top layer 20 and the bottom layer 22 are in contiguous contact to form the straight welds 18.

Figure 8:
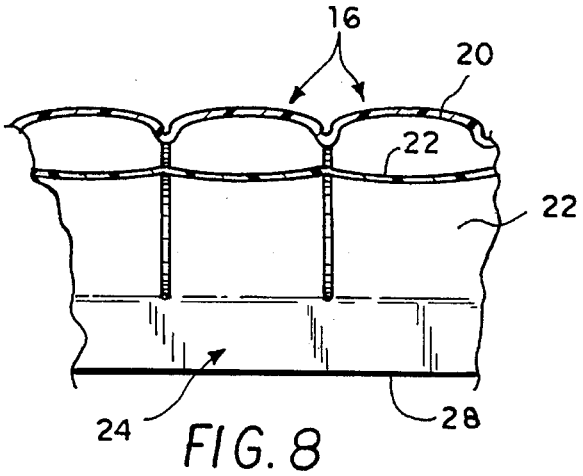
FIG. 8 is an elevational cross section of the welds and chambers of the toilet seat cover, fully inflated, drawn along lines 8—8 of FIG. 6.
Figure 8A:
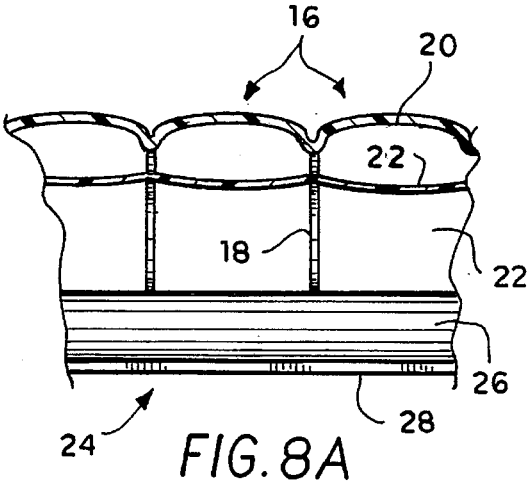
FIG. 8A is an elevational cross section of a second embodiment of the toilet seat cover, drawn along lines 8A—8A of FIG. 6A.

Both FIG. 3 and FIG. 6 show a gripping lip 24, which extends downwards along the periphery of the cover 10 and is in part formed by the peripheral weld 28 of the top layer 20 and bottom layer The top layer 20 is preformed and dimensioned to be slightly larger in surface area than the bottom layer 22. Upon inflation, the added surface area results in a greater curvature of the upper surface than the lower surface of a section 16. As shown in FIG. 4 and FIG. 5, the gripping lip 24 is initially folded under the bottom layer 22. An area of stiffness in the sheet material may be added to help retain the return bend 32 of the lower layer 22 and form the downward gripping lip 24. Thus, in an inflated condition, the top layer 20 and bottom layer 22 are held in a semi-rigid condition; the lip is likewise held semi-rigidly in a downward position by the same forces. As can be appreciated from FIG. 2, the resulting inflated section 16 is preferably only a few centimeters in height when inflated and is adapted to seat on and over the upper surface and edges of a standard hard toilet seat As may be observed in FIG. 6A, the gripping lip 24 may also include an tubular air passage 26 causing a bulging of the gripping lip 24. The tubular air passage 26 helps grasp the lower, outer edge of the toilet seat S. A comparison of FIG. 8 and FIG. 8A shows that the tubular air passage 26 is eliminated when the weld 18 extends entirely to the peripheral weld 28 (FIG. 8). When the weld is not extended to the peripheral weld, the tubular air passage 26 is contiguous from section to section 16 along the entire edge of the cover 10 (FIG. 8A).

As shown in FIG. 1, the cover 10 includes an inlet valve 12, for inflation of the cover by mouth. Referring to the valve as shown in isolation in FIG. 9, the inlet valve 12 is an integral assembly including a tube 34, having a proximate end 34*a* and a distal end 34*b*, the distal end 34*b* being integrally and permanently connected to the base of a vesicle 36, formed by an incurving or pouching of a wall 40 of the cover 10. The sheet material forming the wall 40 may be either the top layer 20 or the bottom layer The material may be stiffened to help maintain its shape in the absence of a deforming force; however, the valve may also be made separately from the wall material and attached to the wall later by appropriate means. Each of a pair of opposing adhesive areas 38 are located on the interior surface of the incurved wall 40, above and below the vesicle 36.

Figure 9:
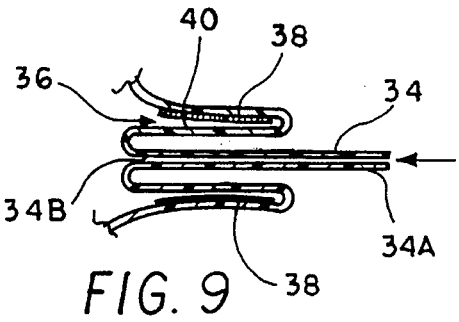
FIG. 9 is a cross section of the inlet valve in an open configuration.
Figure 10:
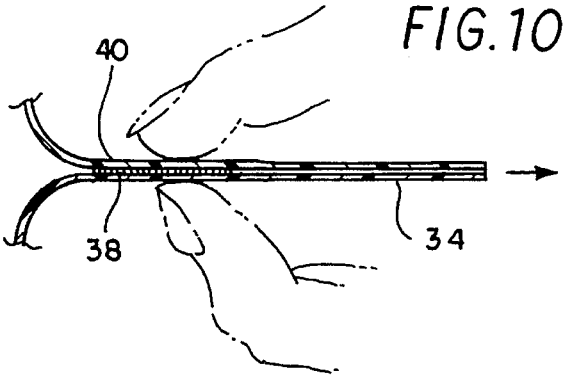
FIG. 10 is a cross section of the inlet valve in a sealed configuration.

As indicated by the arrow in FIG. 9, the exterior air is in communication with the interior of the cover 10 through the tube 34, the distal end 34*b* being engulfed by the walls of the vesicle 36. The vesicle 36 prevents the opposing adhesive areas 38 from coming into contact with one another. Upon complete inflation of the cover 10, the tube 34 may be manually pulled in the direction of its longitudinal axis, inverting the walls of the vesicle 36, whereby the tube 34 is entirely extruded from the vesicle 36. As shown in FIG. 10, a manual pinching action to the walls 40 result in the opposing adhesive spots 38 to be brought together to form an air-tight seal behind the tube 34.

Referring again to FIG. 1 and FIG. 3, the outlet valve 14 is a longitudinal slit located on at least one wall of the cover 10, in this instance the top layer 20, covered by a flap 40, which flap is air-tightly sealed by a releasable adhesive strip 42 to the continuation of the upper layer 20. The outlet valve 14 is of sufficient length to allow immediate release of substantially all air in the cover 10, so that the user need not excessively manipulate the cover to dispose of it. As can be best appreciated from FIG. 3, the slit is covered by a flap 40, which is an extension of the upper layer 20 sufficient in length to grasp between a user's thumb and forefinger. The adhesive strip 42 is located on the interior surface of the flap 40 and makes contact with the exterior surface of continuation of the upper layer 20. Alternative seals, such as plastic zipper lock strips (of the ZIP-LOCK™ type), may be used.

It is to be understood that the present invention is not limited to the embodiments described above, but encompasses any and all embodiments within the scope of the following claims.

I claim:

1. A generally U-shaped inflatable toilet seat cover comprising:

a top layer and a bottom layer, each said top layer and said bottom layer further comprised of a flexible and air-impermeable sheet material dimensioned and configured to define a pair of arms and an arc, each said arm and said arc having an inner edge, an outer edge, and a gripping lip extending downward from said inner edge and said outer edge, wherein said top layer has a greater surface area than said bottom layer, wherein said top layer and said bottom layer are bonded along the entire periphery of said sheet materials to form a continuous and air-tight peripheral weld defining a continuous wall, an interior surface, an exterior surface, and a cavity capable of retaining pressurized air;

a plurality of welds for bonding said top layer to said bottom layer, wherein said welds are configured generally perpendicular to the peripheral weld and interruptedly extend from said inner edge to said outer edge of said arms and said arc, each of said plurality of welds defining at least one interruption in each of said plurality of welds;

an inlet valve for inflation of the cover; and an outlet valve for deflation of the cover.

2. The inflatable toilet seat cover according to claim 1, wherein said inlet valve further comprises a tube, having a proximate end and a distal end, said distal end being integrally connected with a vesicle integrally connected with said continuous wall, said vesicle comprised of a wall having an annular, deformable return bend enabling said wall to form said vesicle within said continuous wall; and, an adhesive applied to said interior surface in close proximity to said distal end of said tube, said adhesive defining at least one adhesive area on said interior surface physically separated from said continuous wall by said vesicle, said at least one adhesive area being capable of forming an air-tight seal when brought into contact with said continuous wall, whereby deformation of said return bend enables the exposure of said at least one adhesive area to another of said at least one adhesive area further allowing each of said at least one adhesive area to be brought together into an air-tight seal.

3. The inflatable toilet seat cover according to claim 2, wherein said at least one adhesive area is an annular ring on said interior surface of said continuous wall.

4. The inflatable toilet seat cover according to claim 2, wherein each of said at least one adhesive area defines an opposing adhesive area.

5. The inflatable toilet seat cover according to claim 1, wherein said outlet valve further comprises an upper lip and a lower lip in said continuous wall defining a longitudinal aperture;

a longitudinal flap of a length greater than said longitudinal aperture, said flap, having an outer surface and an inner surface, fixedly and integrally attached to one of said upper lip and said lower lip in parallel relation to said aperture and adapted to cover said aperture;

a releasable adhesive strip on said inner surface of said flap adapted to air-tightly seal said aperture.

6. The inflatable toilet seat cover according to claim 1, wherein said welds define two interruptions at a point approximately one third of the distance from said inner edge and a point approximately one third of the distance from said outer edge.

7. The inflatable toilet seat cover according to claim 6, wherein said welds are adapted to allow passage along said interior of said cavity along the peripheral weld thereby forming an outpouching of said gripping lip.

8. A generally U-shaped inflatable toilet seat cover comprising:

a top layer and a bottom layer, each said top layer and said bottom layer further comprised of a flexible and air-impermeable sheet material dimensioned and configured to adapt to define a pair of arms and an are, each said arm and said arc having an inner edge, an outer edge, and a gripping lip extending downward from said inner edge and said outer edge, wherein said top layer has a greater surface area than said bottom layer, wherein said top layer and said bottom layer are bonded along the entire periphery of said sheet materials to form a continuous and air-tight peripheral weld defining a continuous wall, an interior surface, an exterior surface, and a cavity capable of retaining pressurized air;

a plurality of welds for bonding said top layer to said bottom layer, wherein said welds are configured generally perpendicular to the peripheral weld and interruptedly extend from said inner edge to said outer edge of said arms and said arc, each of said plurality of welds defining at least one interruption in each of said plurality of welds;

an inlet valve for inflation of the cover, further comprising a tube, having a proximate end and a distal end, said distal end being integrally connected with a vesicle integrally connected with said continuous wall, said vesicle comprised of a wall having an annular, deformable return bend enabling said wall to form said vesicle within said continuous wall;

an adhesive applied to said interior surface in close proximity to said distal end of said tube, said adhesive defining at least one adhesive area on said interior surface physically separated from said continuous wall by said vesicle, said at least one adhesive area being capable of forming an air-tight seal when brought into contact with said continuous wall, whereby deformation of said return bend enables the exposure of said at least one adhesive area to another of said at least one adhesive area further allowing each of said at least one adhesive area to be brought together into an air-tight seal; and an outlet valve for deflation of the cover.

9. The inflatable toilet seat cover according to claim 8, wherein said outlet valve further comprises:

an upper lip and a lower lip in said continuous wall defining a longitudinal aperture;

a longitudinal flap of a length greater than said longitudinal aperture, said flap, having an outer surface and an inner surface, fixedly and integrally attached to one of said upper lip and said lower lip in parallel relation to said aperture and adapted to cover said aperture; and a releasable adhesive strip on said inner surface of said flap adapted to air-tightly seal said aperture.

* * * * *